United States Patent [19]

Tooley

[11] 4,405,254

[45] Sep. 20, 1983

[54] SCAFFOLDING

[75] Inventor: Jack R. Tooley, Cobham, England

[73] Assignee: Acrow Limited, London, England

[21] Appl. No.: 272,512

[22] Filed: Jun. 11, 1981

[30] Foreign Application Priority Data

Oct. 27, 1980 [ZA] South Africa ..... 80/6590

[51] Int. Cl.[3] ..... E04G 7/00

[52] U.S. Cl. ..... 403/246; 403/49; 182/179

[58] Field of Search ..... 403/49, 256, 246; 182/179, 178

[56] References Cited

U.S. PATENT DOCUMENTS 3,179,212 4/1965 Gostling ..... 403/49 X

FOREIGN PATENT DOCUMENTS 1163532 9/1969 United Kingdom ..... 403/49

*Primary Examiner*—Andrew V. Kundrat

*Attorney, Agent, or Firm*—Wood, Herron & Evans

[57] ABSTRACT

The invention relates to scaffolding in which the uprights have sockets projecting outwardly at spaced positions along their length, the horizontal cross members of the scaffolding having spigots to engage in the sockets, a captive wedge being provided to cause the spigots to be clamped against the socket or upright. Such scaffolding in accordance with the invention is arranged so that in use the spigot is inserted into a socket and the wedge acts between the outside surface of the socket on the surface of the cross member tightly to draw the spigot against the corresponding inside surface of the socket. The "lower" narrower end of the wedge is formed or provided with a projection which, when the wedge is moved upwardly relative to the cross member it wedges against the surface of the cross member to hold the wedge in the withdrawn "uppermost" position so that the spigot can readily be removed from the socket.

7 Claims, 8 Drawing Figures

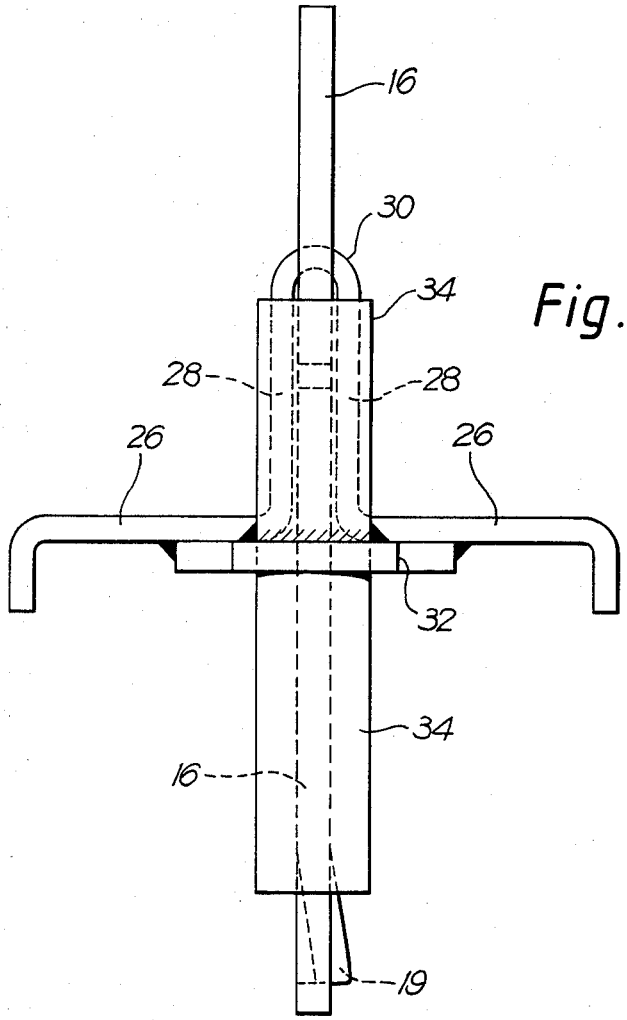
Fig.5
Fig.6
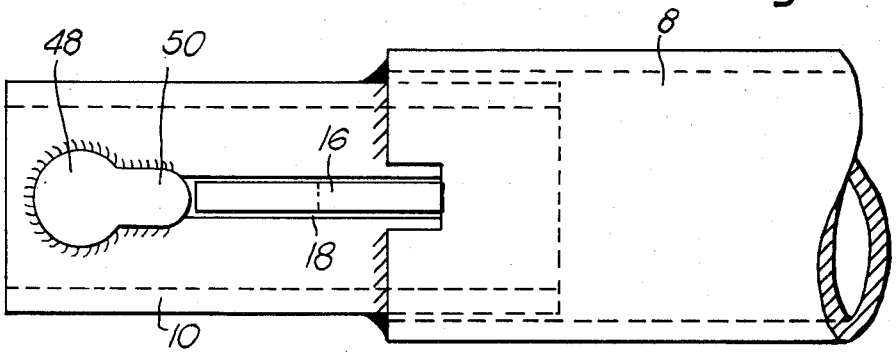

SCAFFOLDING

This invention relates to scaffolding and in particular to scaffolding of the type comprising "vertical" or "upright" members each having, at, at least one position along its length, one or more (preferably four) angularly spaced sockets projecting outwardly from its surface and "horizontal" or "cross" members (ledgers or transoms) provided at one or both ends with a spigot to engage in a socket of a vertical member, and a captive wedge which, in use, causes the spigot to be clamped against the socket or upright.

Such scaffolding is easy and quick to erect and dismantle without the use of special tools.

A cross member of scaffolding of the type described in accordance with the invention has, at one or both ends, a spigot positioned outwardly of the wedge, the arrangement being such that, in use, the spigot is inserted into a socket of an upright and the wedge acts between the outside surface of the socket and a surface(s) of the cross member tightly to draw the spigot against the corresponding inside surface of the socket, the "lower" narrower end of the wedge being formed, or provided with, a projection which, when the wedge is moved upwardly relative to the cross member, itself wedges against a surface of the cross member to hold the wedge in a withdrawn "uppermost" position.

If the cross member is a ledger it is preferably tubular and provided at one or both ends with a tubular projection preferably of smaller diameter than the main tubular body, the tubular projection being formed with a slot through which the wedge passes, the spigot depending downardly at the outer end of the projecting tube. The use of a smaller diameter end tube for each ledger enables a ledger attached to one of four sockets spaced at say 90° around an upright, to be moved around the upright through at least 180° without fouling the upright.

Alternatively, the spigot pin may be so shaped, for example, with a key hole shape cross-section as to be engageable in a V-section socket on an upright which prevents the ledger from being moved angularly around an upright.

The sloping wedge face is preferably that positioned away from the spigot and bears against the inner edge(s) of the lower slot in the tubular member, the upper slot being longer than the lower and preferably extending into the tubular portion of the main tubular body.

The straight face of the wedge adjacent the spigot may be formed in two sections, the lower being stepped inwardly from the upper by a distance equal to the thickness of the wall of the socket. Thus whilst the upper section bears against the inside of the spigot above the socket, the lower section bears against the outside of the socket.

The "lower", bottom edge of the wedge is preferably cut back at an angle to provide a "lead" for the wedge to clear the upper edge of the outer socket wall.

If the cross member comprises a transom this may be formed of two right angle section members positioned back to back, a plate being secured across the horizontal flanges of the angle at the outer end thereof. The spigot may then be secured to the outer end faces of the angle members and through the plate. The wedge may pass between the angle members and through a slot in the plate, its tapering inner surface bearing against a pin or its equivalent (e.g. a deformation of an upright flange of the angle member) extending across the space between the angle members.

Alternatively, and in some ways preferably, the transom may comprise a single pressing having two outwardly extending flanges and central upstanding portion the sides of which are separated, a plate being secured across the bottom of the flanges at each end and carrying the spigot pin, the wedge passing through a slot in the top of the upstanding portion and down between the sides thereof and finally through a slot in the plate.

The invention will now be further described by way of example with reference to the accompanying drawings in which:

FIG. 5 is an end elevation corresponding to FIG. 3;

FIG. 6 is a plan view of an alternative embodiment of ledger end in accordance with the invention;

Figure 1:
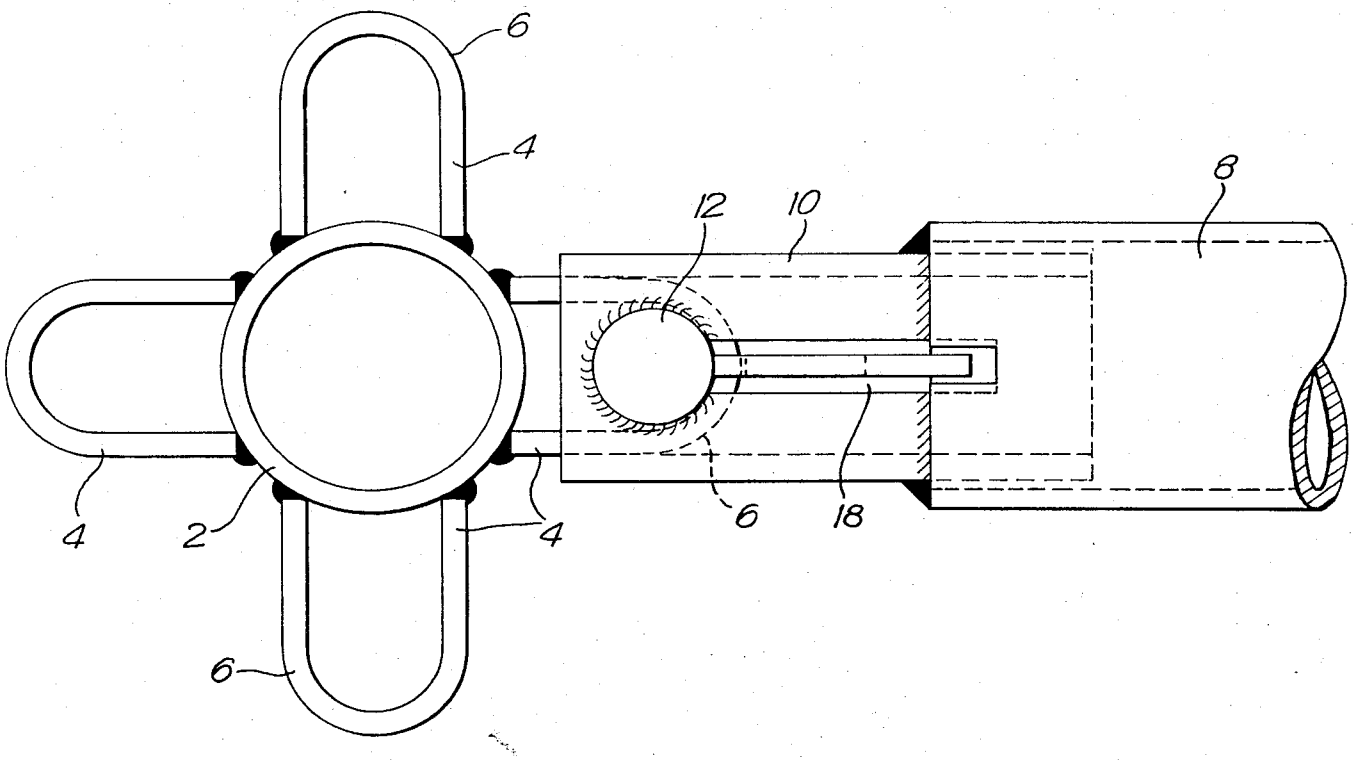
FIG. 1 is a plan view of a ledger in accordance with the invention connected to a socket of an upright.
Figure 2:
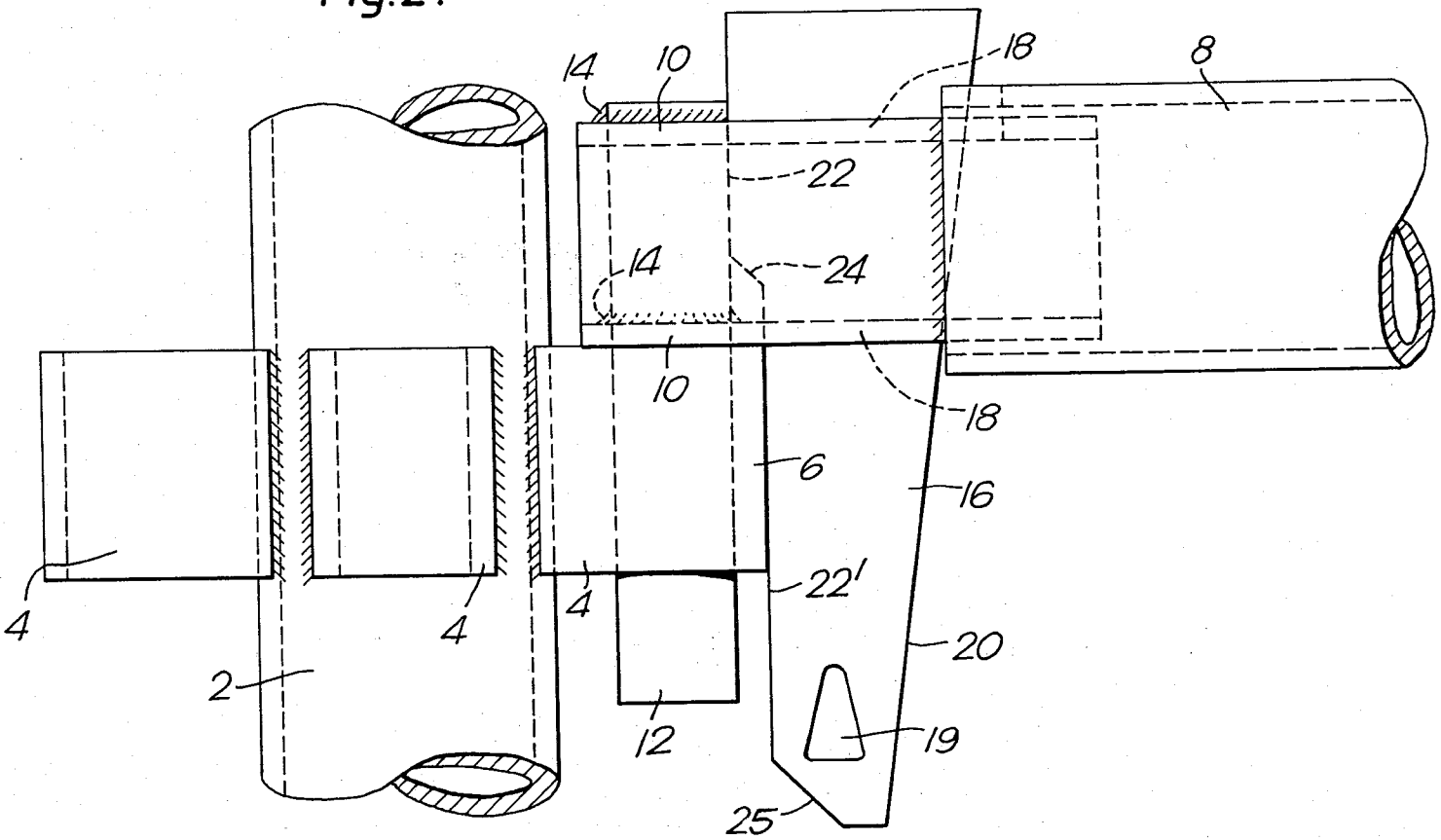
FIG. 2 is side elevation corresponding to FIG. 1.

Referring to FIGS. 1 and 2 the scaffolding comprises an upright or vertical tubular member 2 having at intervals along its length four sockets 4 spaced at 90° around the periphery of the upright. Each socket is of U shape in plan having a closed radiused outer end 6.

The tubular cross member 8 which is in the form of a ledger, has, at each end, a short length of smaller diameter tube 10 which is inserted into the plain open end of the main tube 8 and welded therein.

A spigot pin 12 passes through aligned holes at the outer end of the projecting tube 10 and depends downwardly therefrom as can clearly be seen in FIG. 2. The pin 12 is welded to the tube 10 at 14.

A wedge 16 extends through slots 18 formed in the upper and lower surface of the tubular projection 10, the upper slot 18 being somewhat longer than the lower.

The bottom or lower end of the wedge is formed with a deformation 19 which projects outwardly from the side of the wedge and tapers upwardly towards the bottom of the wedge so as, in effect, to create a counter-wedge.

When the main wedge is knocked upwardly the counter-wedge 19 wedges against the side of the lower slot 18 so as to hold the wedge in its uppermost inoperative position.

The sloping edge 20 of the wedge bears against the inner edge of the lower slot 18 at a point where the two tubes 8 and 10 overlap.

The "straight" edge 22 of the wedge opposite the sloping edge 20 is formed into two sections 22, 22' the lower section 22' being stepped inwardly at 24 from the upper section 22, by a distance equal to the thickness of the outer wall of the curved end 6 of the socket.

When the scaffolding is being erected in use the spigot pin 12 is inserted into a socket 4 and the wedge 16 is knocked downwardly to the position shown in FIG. 2 in which it wedges tightly with the outer surface of the socket wall so as to draw the spigot pin 12 against the inner wall of the socket to lock the ledger to the upright.

It will be seen that in use the upper straight section 22 engages against the inner edge of the spigot pin 12 above the socket.

When the ledger is to be removed from the upright the wedge 16 is knocked upwardly until the deformation or counter-wedge 19 engages the side walls of the slot 18 in the lower wall of the tubular projection 10 so as to hold the wedge in its non-operative position enabling the ledger easily to be lifted to withdraw the spigot pin from the socket.

During erection the wedge may also be held in its upper in-operative position by the counter-wedge and thus not interfere with the insertion of the spigot into a socket.

The lower end of the wedge is formed with a taper 25 to provide a "lead" over the top outer edge of the socket.

It will be appreciated that instead of the tubular outer end of the ledger being of smaller diameter than the main tube, it could be of equal diameter, the inner end of the outer tube portion being swaged and inserted into the main ledger tube. Any problems with fouling of similar tube connected to an adjacent socket may be obviated by cutting away the outer end of the outer tube.

Of course no separate tube section needs to be provided at the outer end of the main tube but provision of such a separate tube enables the wedge and spigot pin assembly to be manufactured separately and then readily connected to the main ledger tube.

As a further alternative the ledger tube may have a plate secured across its open outer end, the spigot pin being secured directly to the outer face of this plate so that it stands proud of the end of the ledger, the wedge then passes through the tube immediately adjacent to its outer end.

Figure 3:
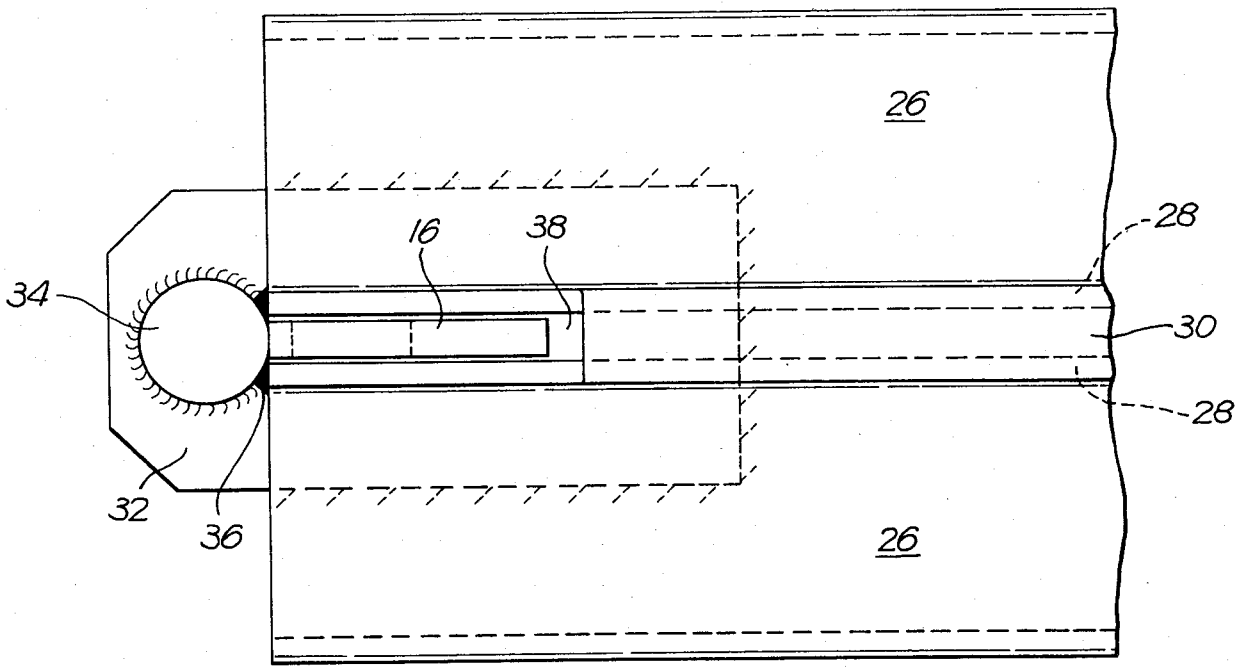
FIG. 3 is a plan view of a transom in accordance with this invention.
Figure 4:
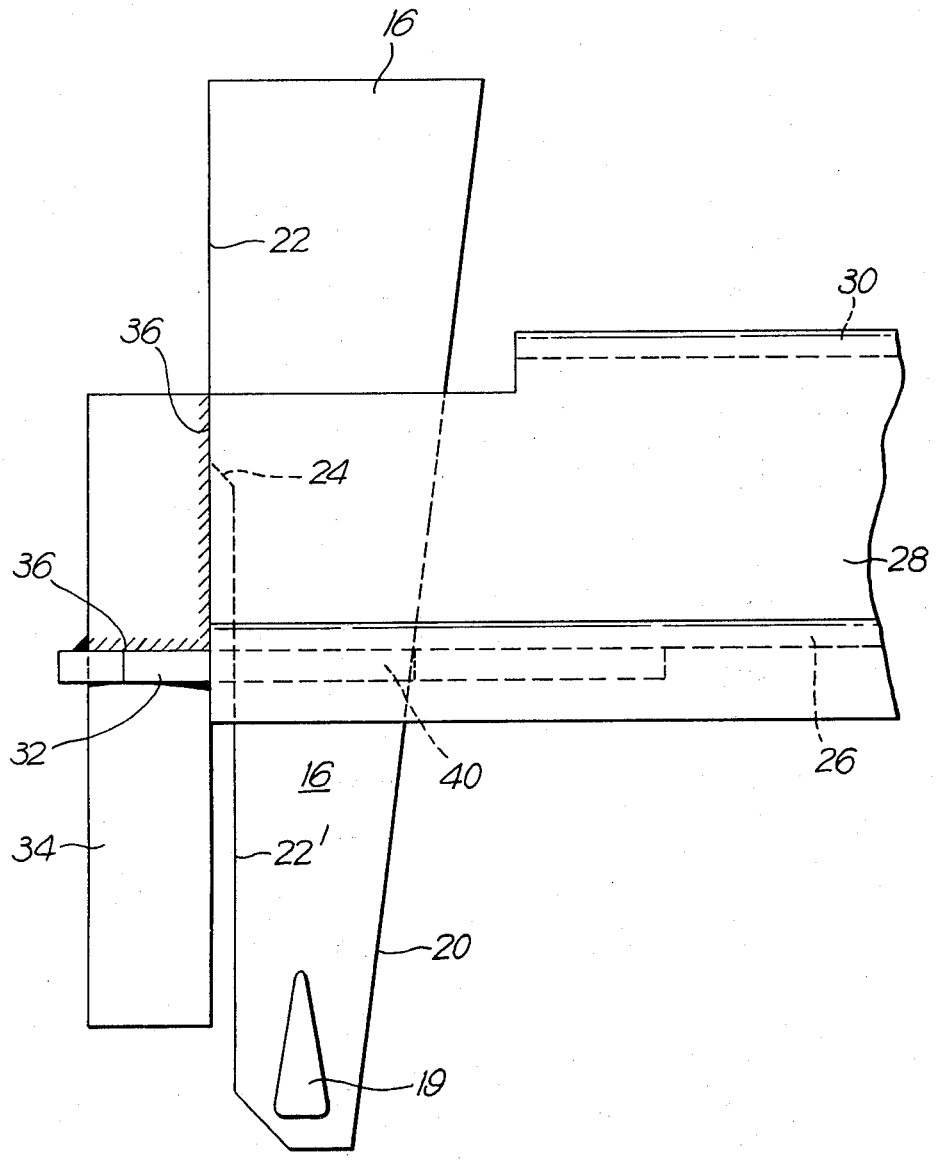
FIG. 4 is a side elevation corresponding to FIG. 3.

Referring to FIGS. 3 to 5 which illustrate the end of a cross member having the form of a transom, it will be seen that the transom member comprises a pressing having two horizontally disposed flanges 26 and an upright portion 28 the two sides of which are spaced apart and are joined by a top curved portion 30.

A plate 32 is welded to the underside of the pressing at each end thereof and extends out from the pressing as can be seen in FIGS. 3 and 4. The plate extension carries a downwardly extending spigot pin 34 which is welded to the plate 32 and its upper portion is also welded to the outer ends of the sides of the upright portion 28 of the pressing, as illustrated at 36.

A slot 38 is formed in the upper curved surface 30 of the upright portion of the pressing and a wedge identical to the wedge 16 described with reference to FIGS. 1 and 2 is positioned through the slot 38 and extends down between the two upright sides 28 of the pressing and through a slot 40 in the plate 32.

In use, the transom is connected to a socket of an upright in the same manner as hereinbefore described with reference to the ledger illustrated in FIGS. 1 and 2.

Instead of the transom member being formed as a single pressing it may be formed of two right angle members positioned back to back and secured together at intervals. In this latter construction the wedge is retained in its position between the angle members by a pin or deformation of one of the members which extends across the gap between the members.

Figure 8:
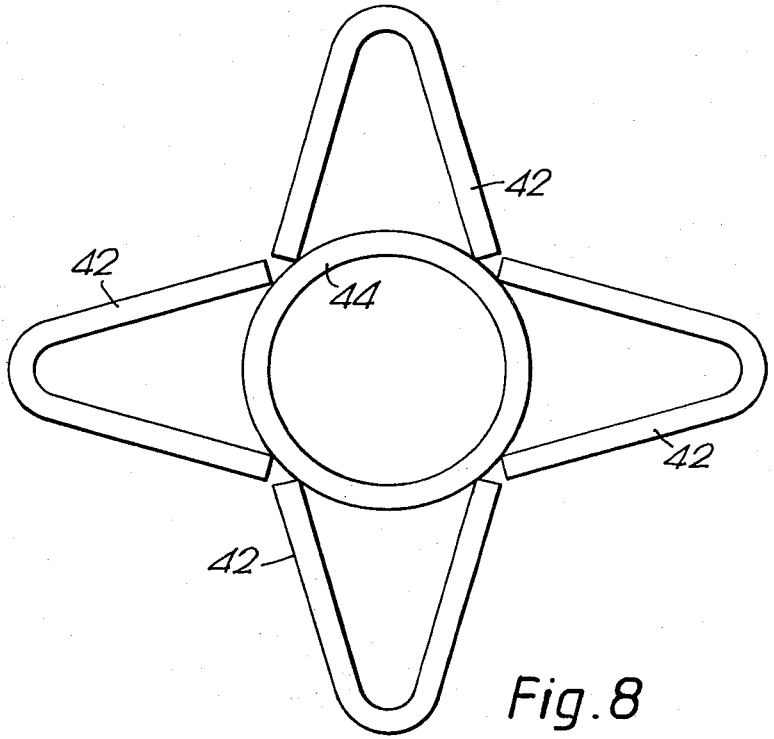
FIG. 8 is a plan view of an upright with V-section sockets to mate with the spigot shown in FIGS. 6 and 7.
Figure 7:
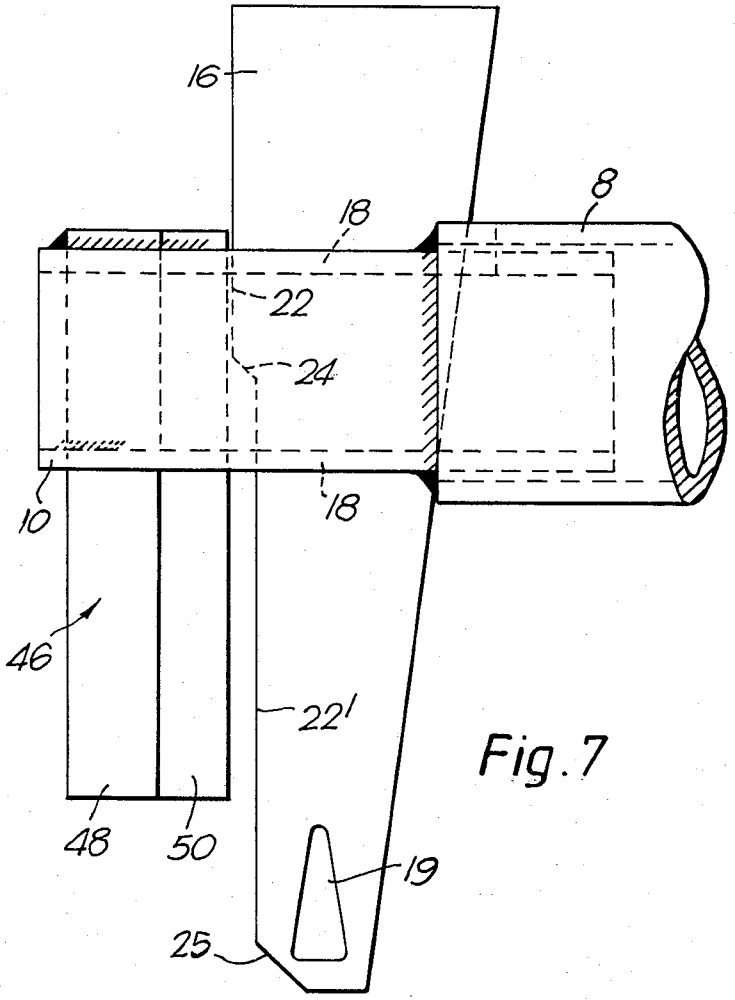
FIG. 7 is a side elevation corresponding to FIG. 6.

The alternative design of spigot pin illustrated in FIGS. 6 and 7 is intended in use to mate with one of four V-shaped sockets 42 located, as shown in FIG. 8, around the periphery of an upright 44.

The ledger tube and wedge are as illustrated in FIG. 1 but the spigot pin 46 has, in plan view, a key hole shaped cross-section with the larger, part cylindrical portion 48, shaped to fit into the wider portion of the V-shaped socket 42 and the thinner part 50 shaped to fit into the narrower part of the V-shaped socket. When so engaged, the ledger is prevented from moving angularly around the upright. There may be four V-shaped sockets positioned around the upright at spaced vertical positions.

Equally, the spigot pin of the transom in accordance with the invention may have the shape illustrated in FIGS. 6 and 7 to engage in a V-section socket.

I claim:

1. A scaffolding clamp device comprising a cross member having a first contact surface and a second contact surface, both of said contact surfaces being adjacent one end of said member, a spigot connected to said cross member at the same end thereof as said contact surfaces, a wedge positioned between said first contact surface and said spigot, said wedge defining a two section surface adjacent said spigot, one section of said surface being stepped inwardly from the other section of said surface by a distance equal to the distance between said spigot and the other section of said surface when said wedge is in its clamping position against said first contact surface, and a projection mounted on said wedge, said projection being wedged against said second contact surface to hold said wedge in a non-clamping position when said wedge is withdrawn from its clamping position.

2. A scaffolding clamp device as claimed in claim 1, said cross member comprising a main tubular body, and a tubular projection of smaller diameter than said main tubular body, said tubular projection defining a slot through which said wedge passes, and said spigot being mounted to the outer end of said tubular projection.

3. A scaffolding clamp device as claimed in claim 1, said cross member comprising a main tubular body, a pressing having two outwardly extending flanges and a central upstanding portion, the sides of said central portion being separated to form a slot, and said wedge being positioned within said slot, and a plate secured across the bottom of said flanges, said spigot being mounted to said plate.

4. A scaffolding clamp device as claimed in claim 1, said wedge's narrow end defining a cut away corner.

5. A scaffolding clamp device as claimed in claim 1, said spigot defining a V-shaped cross-section.

6. A scaffolding comprising an upright scaffolding member, at least one socket mounted on the periphery of said upright scaffolding member, a scaffolding cross member having a first contact surface and a second contact surface, both of said contact surfaces being adjacent one end of said member, a spigot connected to said cross member at the same end thereof as said contact surfaces, a wedge positioned between said first contact surface and said spigot, said wedge defining a two section surface adjacent said spigot, one section of said surface being stepped inwardly from the other section of said surface, said one section engaging said socket when said wedge is in its clamping position against said first contact surface, and said other section engaging said spigot when said wedge is in its clamping position against said first contact surface, and a projection mounted on said wedge, said projection being wedged against said second contact surface to hold said wedge in a non-clamping position when said wedge is withdrawn from its clamping position.

7. A scaffolding comprising an upright scaffolding member, at least one socket mounted on the periphery of said upright scaffolding member, a scaffolding cross member having a first contact surface and a second contact surface, both of said contact surfaces being adjacent one end of said member, a spigot connected to said cross member at the same end thereof as said contact surfaces, a wedge positioned between said first contact surface and said spigot, said wedge defining a two section surface adjacent said spigot, one section of said surface being stepped inwardly from the other section of said surface by a distance substantially equal to the thickness of said socket's outer wall, and a projection mounted on said wedge, said projection being wedged against said second contact surface to hold said wedge in a non-clamping position when said wedge is withdrawn from its clamping position.

* * * * *